United States Patent [19]

Seidel et al.

[11] Patent Number: 4,881,396

[45] Date of Patent: Nov. 21, 1989

[54] ROLLING MILL STAND WITH AXIALLY SLIDABLE ROLLS

[75] Inventors: Jürgen Seidel, Kreuztal-Ferndorf; Dieter Rosenthal, Niederfischbach; Jürgen Klöckner, Netphen-Eschenbach, all of Fed. Rep. of Germany

[73] Assignee: SMS Schloemann-Siemag Aktiengesellschaft, Dusseldorf, Fed. Rep. of Germany

[21] Appl. No.: 180,141

[22] Filed: Apr. 11, 1988

[30] Foreign Application Priority Data

Apr. 9, 1987 [DE] Fed. Rep. of Germany ..... 3712043

[51] Int. Cl.[4] ..... B21B 31/18; B21B 37/00; B21B 31/20

[52] U.S. Cl. ..... 72/247; 29/122; 72/8; 72/11; 72/16; 72/199; 72/201; 72/243

[58] Field of Search ..... 72/247, 245, 243, 241, 72/199, 366, 21, 8, 10, 11, 16, 17, 201; 29/122

[56] References Cited

U.S. PATENT DOCUMENTS

| | | | |
|---|---|---|---|
| 3,818,743 | 6/1974 | Kajiwara et al. | 72/247 X |
| 3,857,268 | 12/1974 | Kajiwara | 72/247 |
| 3,902,345 | 9/1975 | Shida | 72/247 X |
| 4,400,957 | 8/1983 | Carlstedt et al. | 72/247 X |
| 4,440,012 | 4/1984 | Feldmann et al. | 72/366 X |
| 4,519,233 | 5/1985 | Feldmann et al. | 72/247 |
| 4,587,819 | 5/1986 | Hausen | 72/247 X |
| 4,656,859 | 4/1987 | Ginzburg | 72/247 X |
| 4,726,213 | 2/1988 | Manchu | 72/247 X |
| 4,730,475 | 3/1988 | Ginzburg | 72/199 X |
| 4,800,742 | 1/1989 | Feldmann et al. | 72/247 |

*Primary Examiner*—Lowell A. Larson
*Assistant Examiner*—Steven B. Katz
*Attorney, Agent, or Firm*—Toren, McGeady & Associates

[57] ABSTRACT

A rolling mill stand with work rolls which are supported as necessary by back-up rolls or by intermediate and back-up rolls. The rolls are axially slidable relative to each other. The bodies of the rolls are provided with alternatingly concavely and convexly shaped contours in such a way that the rolls supplement each other in at least one axial position of the rolls so that no gap exists between the rolls. Corrections of the roll gap between a pair of rolls can be carried out by relative axial displacement of the rolls. The contours of the rolls have in the neutral position thereof, in addition to a maximum inclination in the middle, maximum inclinations of the circumferential lines on both sides of the middle of the circumferential surfaces of the rolls in longitudinal direction of the rolls in which roll gap profile changes are to be effected.

7 Claims, 8 Drawing Sheets

ROLLING MILL STAND WITH AXIALLY SLIDABLE ROLLS

BACKGROUND OF THE INVENTION

1. Field of the Invention

The present invention relates to a rolling mill stand with work rolls which are supported as necessary by back-up rolls or by intermediate and back-up rolls. The work rolls, the intermediate rolls and/or the back-up rolls are axially slidable relative to each other. The bodies of the rolls are provided with alternatingly concavely and convexly shaped contours in such a way that the rolls supplement each other preferably in at least one axial position of the rolls so that preferably no gap exists between the rolls. Corrections of the roll gap profile between a pair of rolls can be carried out by relative axial displacement of the rolls.

2. Description of the Prior Art

A rolled steel strip leaving a cold rolling mill train as a finished product must meet several important requirements. Surface textures should be avoided and the strip should have a constant thickness over its entire length. In addition, in order to avoid unevenness of the strip, it is necessary to roll the strip uniformly over its width, so that internal stresses are avoided which could lead to undesirable undulations in the middle area, the edge area or the quarter area of the strip. The latter can only happen if the roll gap profile under load is correctly adjusted by means of adjusting mechanisms.

It is known, for example, to construct the circumferential surfaces of rolls slightly cambered in order to compensate any roll bending and roll flattening occurring during rolling under the influence of the rolling load. However, such a cambered roll shape is usable only for a given load ratio which is determined by the task to be carried out and the occurring rolling force. When different loads occur, different conditions exist and, thus, an incomplete compensation is carried out. Therefore, in practice, it is necessary to have available rolls of different shapes for different load conditions and to exchange the rolls as required. On the other hand, smaller corrections can be achieved by adjusting the bending of the rolls and possibly by a controlled cooling in certain zones.

German patent 30 38 865 discloses axially slidable rolls of the above-described type which are shaped in such a way that the effect resulting from the contours of two rolls can be determined by the relative axial displacement of the rolls. Thus, as required, practically any parabolic shape can be adjusted for the roll bodies from negative to positive contours of the bodies, so that it is no longer necessary to use different sets of rolls or to exchange the rolls even if the load conditions are substantially changed.

It has been found that the rolls disclosed in German patent 30 38 865, which are bottle-type rolls operating according to the CVC-principle, are capable of compensating parabolic bending over the entire length of the roll bodies, wherein the parabolic bending is determined essentially by quadratic components. However, excessive stretching in the edge area or the quarter area of the strip bridge may lead to undulations in the edge area or the quarter area, can only be reduced by using strong additional bending devices. Usually it is useful to use the bending devices together with cooling in certain zones.

It is therefore, the object of the present invention to provide a rolling mill stand of the above-described type in which it is possible to change roll gaps by merely relatively axially displacing the rolls, so that a steel strip can be obtained which is essentially free of stress and free of undulations.

SUMMARY OF THE INVENTION

In accordance with the present invention, the contours of the rolls have in the neutral roll position maximum inclinations of the circumferential lines on both sides of the middle of the circumferential surfaces of the rolls in longitudinal direction of the rolls in which roll gap profile changes are to be effected. A maximum inclination may also exist additionally in the middle of the rolls.

The present invention utilizes the finding that the essential portion of the roll bending takes place in the shape of a parabola and that, therefore, this bending can be compensated by a parabolic shape of the roll bodies. The contours of such a roll can be described by a polynomial of the second order. The contours of rolls permitting a change of the quadratic component by sliding the rolls according to German patent 30 38 865 can be described by a polynomial of the third order. In accordance with the invention, the same correction can be effected by a variable adjustment by sliding the rolls for error components which may, for example, lead to undulations in the quarter area. It has been found that errors of the profile of a roll gap which results in undulations in the quarter area can be compensated by enveloping curve shapes of rolls whose enveloping curves can be described as polynomials of the fourth quarter.

In accordance with the present invention, it has been found that those curves which can be described as polynomials of the fourth order can be made variable by providing two rolls with mirror-image enveloping curves which can be described as polynomials of the fifth order.

However, it is important to note that only certain equations are useful. Therefore, it has been found significant that by inserting appropriate values a polynomial of the fifth order is determined which results, on the one hand, in the predetermined variation range and which, on the other hand, has the obtainable maximum and minimum inclinations at the desired distances from the normal plane of symmetry of the rolls. Rolls of this type not only make it possible to compensate the quadratic component of the fold bending, but they also make it possible to adjustably and/or controllably influence the error components of the fourth power, so that bending devices, while not becoming completely superfluous, are not as much necessary for obtaining corrections.

Accordingly, in accordance with the present invention, significantly improved possibilities for correction are provided and, thus, the possibilities for obtaining a strip which is free of stress and preferably of uniform thickness are improved even if adverse influences and different load conditions exist. Also, it is possible to securely obtain narrow tolerances.

The various features of novelty which characterize the invention are pointed out with particularity in the claims annexed to and forming a part of this disclosure. For a better understanding of the invention, its operating advantages and specific objects attained by its use, reference should be had to the drawings and descriptive matter in which there are illustrated and described preferred embodiments of the invention.

DETAILED DESCRIPTION OF THE INVENTION

Figure 1:
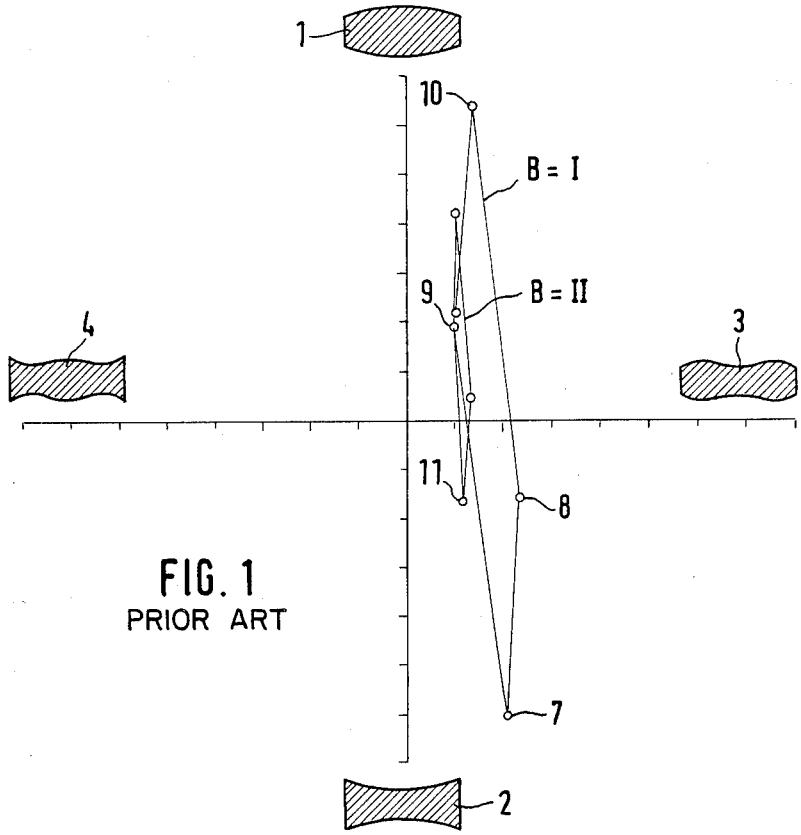
FIG. 1 PRIOR ART
FIG. 1 is a representation of an adjusting field for indicating the possibilities of adjustment of the known rolls having a variable camber.

FIG. 1 of the drawing is a representation of an adjustment field illustrating the possibilities resulting from the use of a conventional, so-called CVC roll pair. This adjustment field shows in vertical direction the quadratic influence on the roll gap, indicated by reference numerals 1 and 2, and the scale provided therebetween which indicates the change of the roll gap in the middle. The non-quadratic changes are indicated by reference numerals 3 and 4 along a horizontal scale, wherein reference numeral 3 indicates positive influence and reference numeral 4 indicates negative influences. For a clear illustration of the obtainable effects, the horizontal scale is substantially enlarged as compared to the vertical scale.

Figure 2:
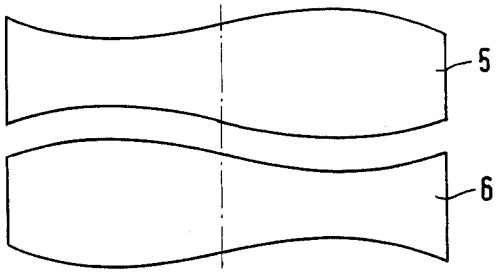
FIG. 2 PRIOR ART
FIG. 2 is a schematic illustration of a pair of rolls whose resulting camber is adjustable by axial sliding of the rolls.

If a pair of rolls is used for a certain strip width I, in which the work roll camber can be continuously adjusted by relative axial displacement of the rolls, for example, the resulting camber of the work rolls 5 and 6 shown in FIG. 2 is adjusted, a quadratic effect on the roll gap profile of an amount −a um can be obtained in one of the extreme displacement positions of the rolls in accordance with reference numeral 7, and a quadratic effect of +b um on the roll gap profile can be obtained in the extreme opposite position in accordance with reference numeral 9. The connecting line between the two points 7 and 9 indicates the adjustment characteristic of the displacement system when the bending force is constant.

By changing the bending forces, the point 7 can be displaced toward point 8 and point 9 can be displaced toward point 10, so that an adjustment field is obtained which is defined by the points 7–10. The connecting lines from point 7 to point 8 and from point 9 to point 10 indicate the adjustment characteristic of the bending system, with the non-quadratic adjustment component being smaller. Any points located within the rhombus formed by the points 7-10, i.e., combinations of quadratic and non-quadratic corrections, can be obtained by appropriate combinations of displacement and bending forces applied. The obtained adjustment field 7–10 is relatively high but narrow, so that quadratic deviations can be corrected to a relatively great extent, while only slight non-quadratic deviations can be corrected. If used in connection with narrow strip widths, a substantially smaller adjustment field is created which starts in point 11 and does not permit any non-quadratic corrections.

Figure 3:
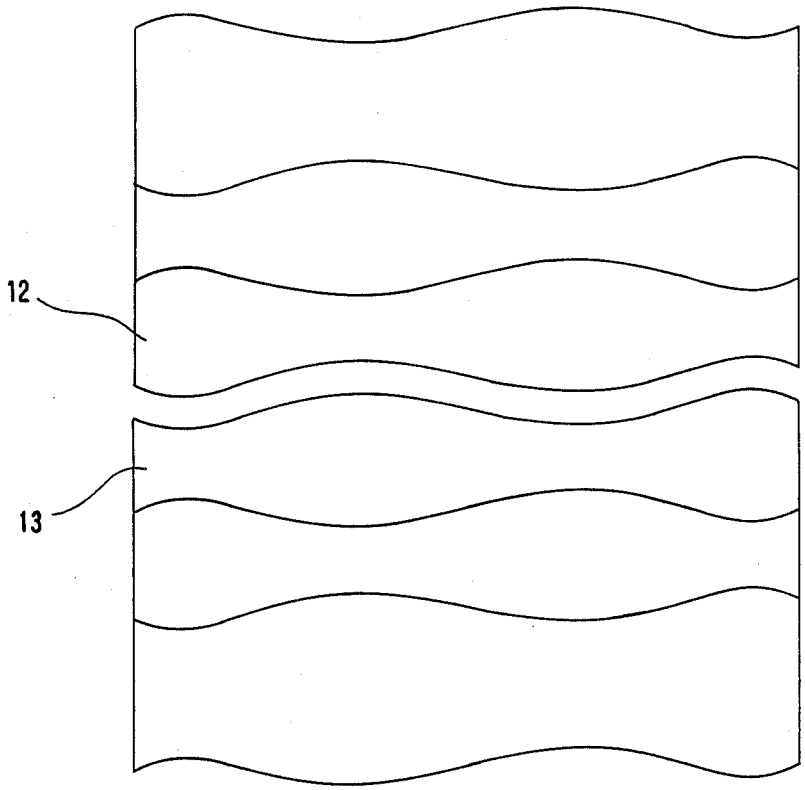
FIGS. 3 and 4 are schematic illustrations of rolls which can be used for compensating non-quadratic errors.

For improving the possibilities of correction, rolls of the type of work rolls 12 and 13 of FIG. 3 are provided. The contours defining the circumferential surfaces of the work rolls 12 and 11 can be described by a polynomial of the fifth order. A superficial observation already shows that these contours have three maxima of the gradient or points of inflection. One of these maxima is approximately in the middle, while the other two are located symmetrically relative to the middle plane. The points of inflection represent the steepest inclinations because the inclination increases in front of the point of inflection while it decreases behind the point of inflection. However, these points of greatest inclination require the greatest effect when the rolls are displaced. It can be imagined as two conical surfaces which are displaced relative to each other, wherein the upper conical member is raised or lowered depending upon the feeding direction. However, in order to obtain a continuous effective curve which is free of steps and interruptions, it is necessary to design the contour in such a way that it represents a polynomial of the fifth order in which the radius r is a function of x, wherein x represents the axial distance from the normal middle plane of the roll.

Details of this curve can already be indicated if it is assumed that, for example, in the middle a certain effect, previously known as the CVC effect, exist and if it is determined at what lateral distances from the middle plane additional maximum effects are to be achieved. In practice, only one of the curves will be used, the middle diameter will be given and the locations of the points of inflection and the gradients in the points of inflection will also be given. However, in practice, in order to achieve more accurate results, when laying down the equation of the fifth order, certain points will be given and the contour itself will not e considered; rather, the distance of two contours which have been displaced relative to each other will be displaced, wherein the relative displacement is added as the sixth variable.

Figure 5:
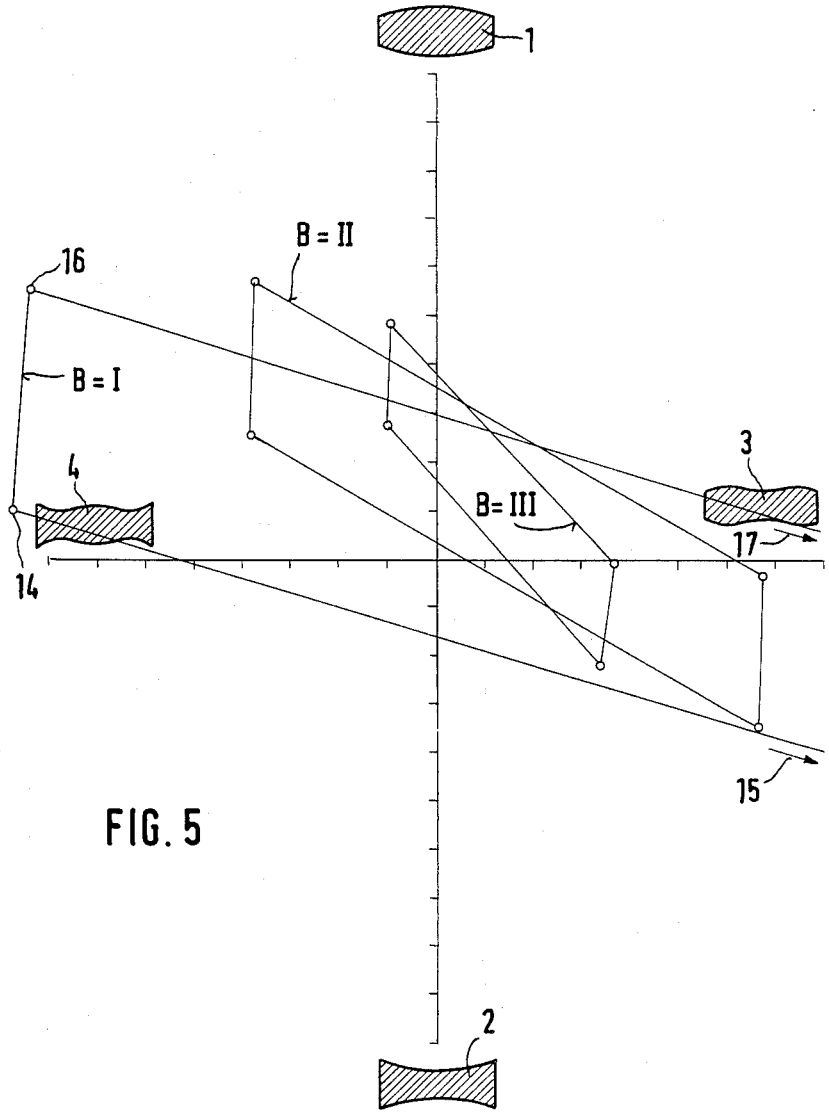
FIG. 5 is an adjustment field resulting in connection with the rolls illustrated in FIG. 3.

The advantageous effect can be evaluated by means of the adjustment field of FIG. 5. In FIG. 5, the same scales and the same symbols are used as in the adjustment field of FIG. 1. In the case of a first strip with B=I, the point 14 results as well as the point 15 which is located outside of FIG. 5. By the application of a bending action, point 14 is moved to point 16 and point 15 to point 17 which is also located outside of FIG. 5. A comparison with the adjustment field of FIG. 1 clearly shows that substantially wider adjustment possibilities are provided and that particularly the correcting possibilities of the non-linear error component have been improved by a factor which exceeds 20. While the compensation possibility of quadratic errors is reduced, this reduction does not even exceed the factor two. Additional rhombi which are smaller and slightly turned indicate corresponding correcting values for smaller strip widths II and III.

Figure 4:
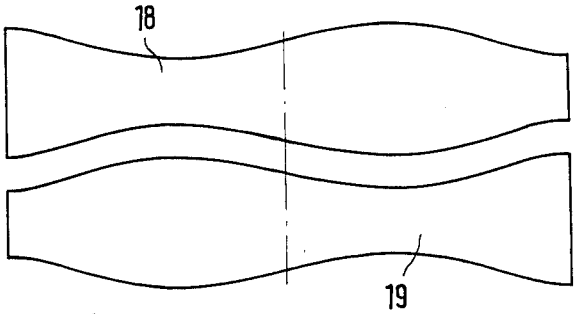

Another pair of rolls 18, 19 is illustrated in FIG. 4. In FIG. 4, the radius differences are illustrated substantially exaggerated in the manner of suppressed zero, in order to clearly show the characteristic contours of the envelope curves. In reality, in rolls which have an average roll diameter of, for example, between 300 and 700 mm, radius differences are used which are generally below 1 mm and exceed 1 mm usually only slightly and only in special cases. However, such small diameter and radius changes cannot be recognized in a drawing drawn to scale.

Figure 6:
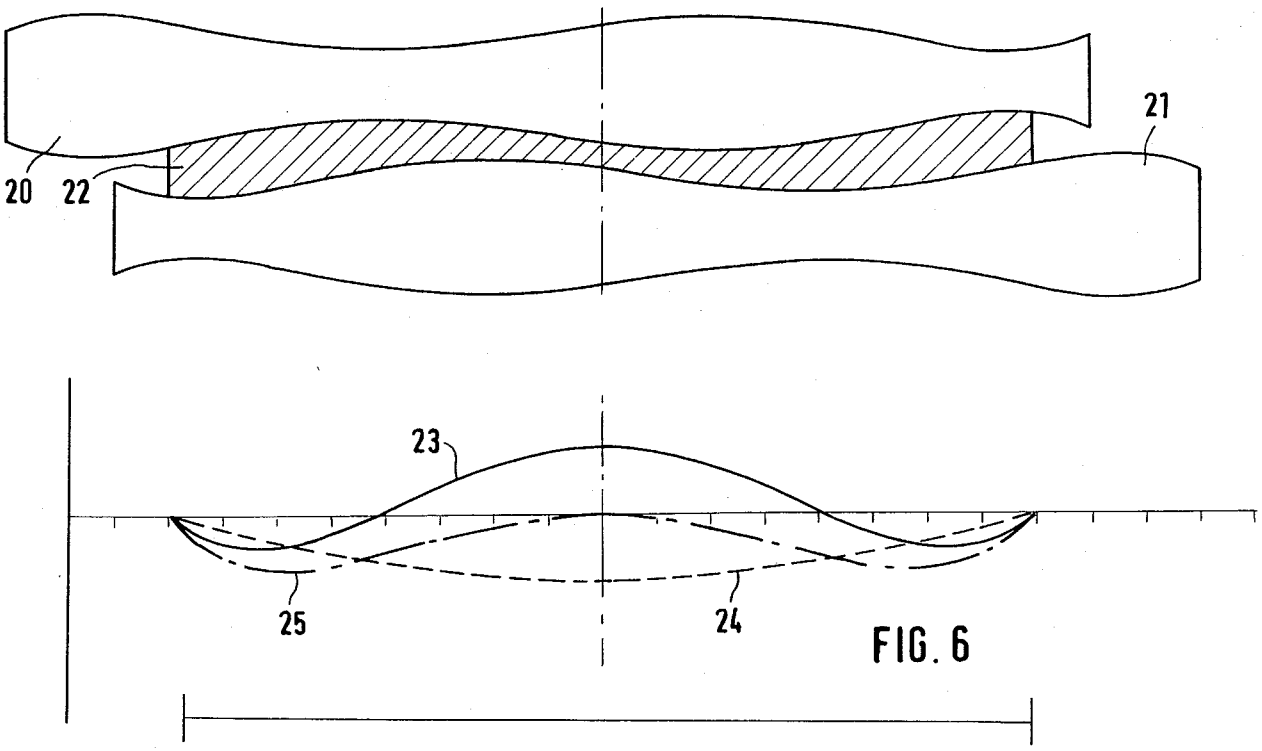
FIG. 6 is a schematic illustration of a pair of rolls which are slid axially relative to each other, including a graphic representation of the change of the roll gap as a result of the relative sliding of the rolls.
Figure 7:
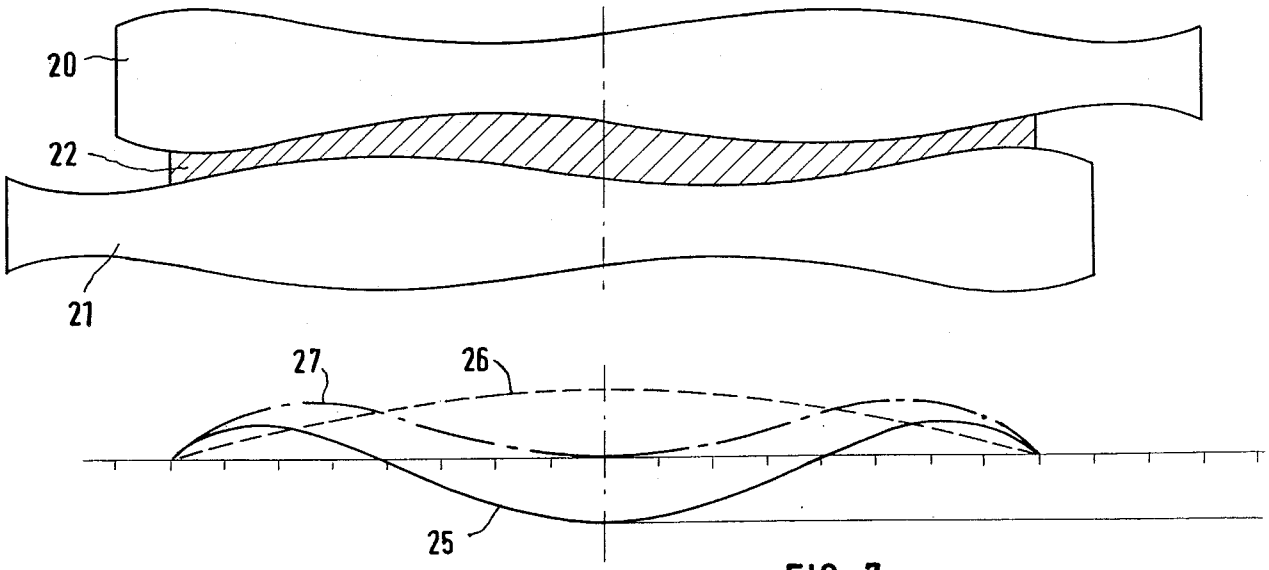
FIG. 7 is an illustration of the pair of rolls of FIG. 6 in the opposite extreme position of the rolls, including a graphic representation of the resulting changes in the roll gap.

Additional embodiments of the invention are discussed with the aid of FIGS. 6 and 7. In FIG. 6, the upper work roll 20 has been displaced relative to the lower work roll 21 to the left as seen in FIG. 6. Accordingly, it can be seen that the material 22 is recognizably rolled out more in the middle than at the two edges and in the sections near the edges it is rolled out less than the edges themselves.

A roll constructed in this manner results when it is free of load in equivalent camber according to curve 23. A curve 25 represented by a polynomial of the fourth order results by superimposing a quadratic component according to curve 24 either under load or by the use of a bending unit or by the adjustment of another pair of supporting CVC rolls.

In FIG. 7, the same rolls 20 and 21 and the material 22 to be rolled placed between the rolls are shown as in FIG. 6. However, the bending forces are reversed and the rolls are also displaced into their opposite extreme positions, i.e., roll 20 has been moved to the right and roll 21 has been moved to the left as seen in FIG. 7.

The contours of the rolls shown in FIG. 7 result in a correcting curve 26 and a bending line 27 results, for example, from a bending device, so that the two curves 26 and 27 result in a resulting curve 28. As these illustrations show, without influencing the middle portions, the quarter areas of the rolls can be rolled out more or less as desired. In addition, by appropriately adjusting the bending device, the middle portion can be rolled out more or less strongly and, thus, an additional correction of the quadratic component can be effected.

Figure 8:
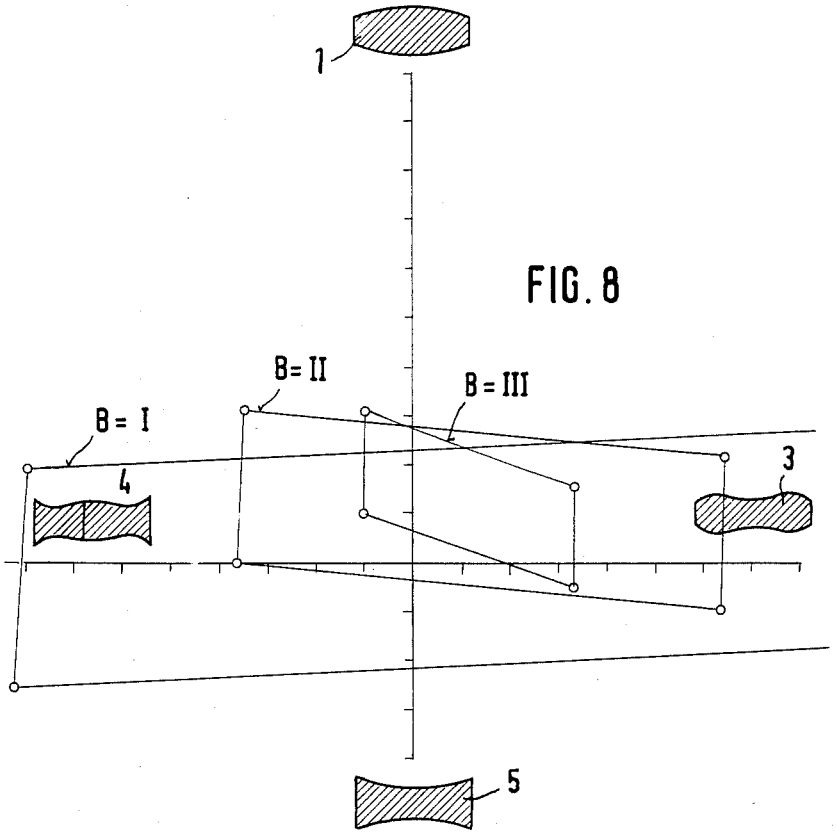
FIG. 8 is another adjustment field.
Figure 9:
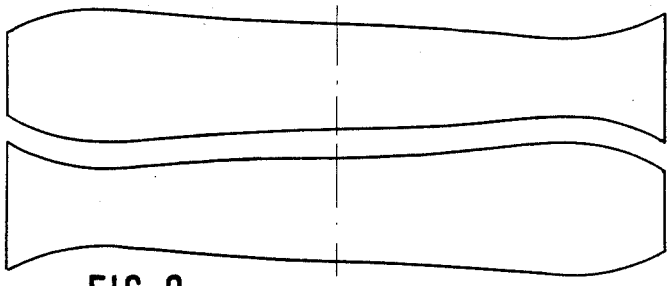
FIG. 9 is a schematic illustration of a pair of rolls which produces the adjustment field shown in FIG. 8.

FIG. 9 of the drawing shows rolls of a different shape in which the influences in the quadratic component are changed. Points of inflection can be found essentially at the same distances on both sides from the normal middle plane. In the corresponding adjustment field shown in FIG. 8, an almost rectangular, large adjusting area can be seen for a first strip with I. This adjustment area permits great quadratic corrections as well as non-quadratic corrections which are lower but still significant. Two additional adjustment fields which are turned clockwise and have a smaller area are those of reduced strip widths II and III.

The adjustment possibilities are not limited by the above-described rolls. Basically, it is possible to use conventional cambered contours which can be described by quadratic polynomials by introducing the so-called CVC shape which can be described by a polynomial of the third order and usually has a point of inflection in the middle plane of the roll and which permits a continuous correction of quadratic errors. Finally, the contour according to the present invention is added which follows a polynomial of the fifth order and has at least two points of deflection which usually are located approximately equidistant from the normal middle plane.

The different curves of this type can be utilized as envelope curves of different pairs of rolls. For example, in a six-high roll stand, the back-up rolls may have a quadratic contour corresponding to a conventional camber, intermediate rolls may have a contour which corresponds to a polynomial of the third order and is described as a CVC shape, and the work rolls may have a contour correspondingly to a polynomial of the fifth order. On the other hand, it is also possible to provide a pair of rolls with a contour which corresponds to the sum of two or three polynomials of the same order or also of different orders. For example, polynomial of the fifth order may be represented twice in such a way that the points of inflection thereof, and thus, the maximum effects, are located at different distances from the normal middle plane of the rollers. Finally, it is not necessary that only similar rolls also have similar contours. For example, a work roll may have a certain contour and a back-up roll supporting the work roll may have the corresponding mirror-image contour, while the opposite work and back-up rolls may have another, second contour. Moreover, it is possible to provide corresponding rolls of a pair of rolls with contours which correspond to the sum of two or more polynomials.

The displacement of the rolls may be controllable, so that recognized adjustment errors can be corrected. However, the displacement drives are preferably actuated as adjustment units of a resulting device which operates in accordance with the following principle.

Figure 10:
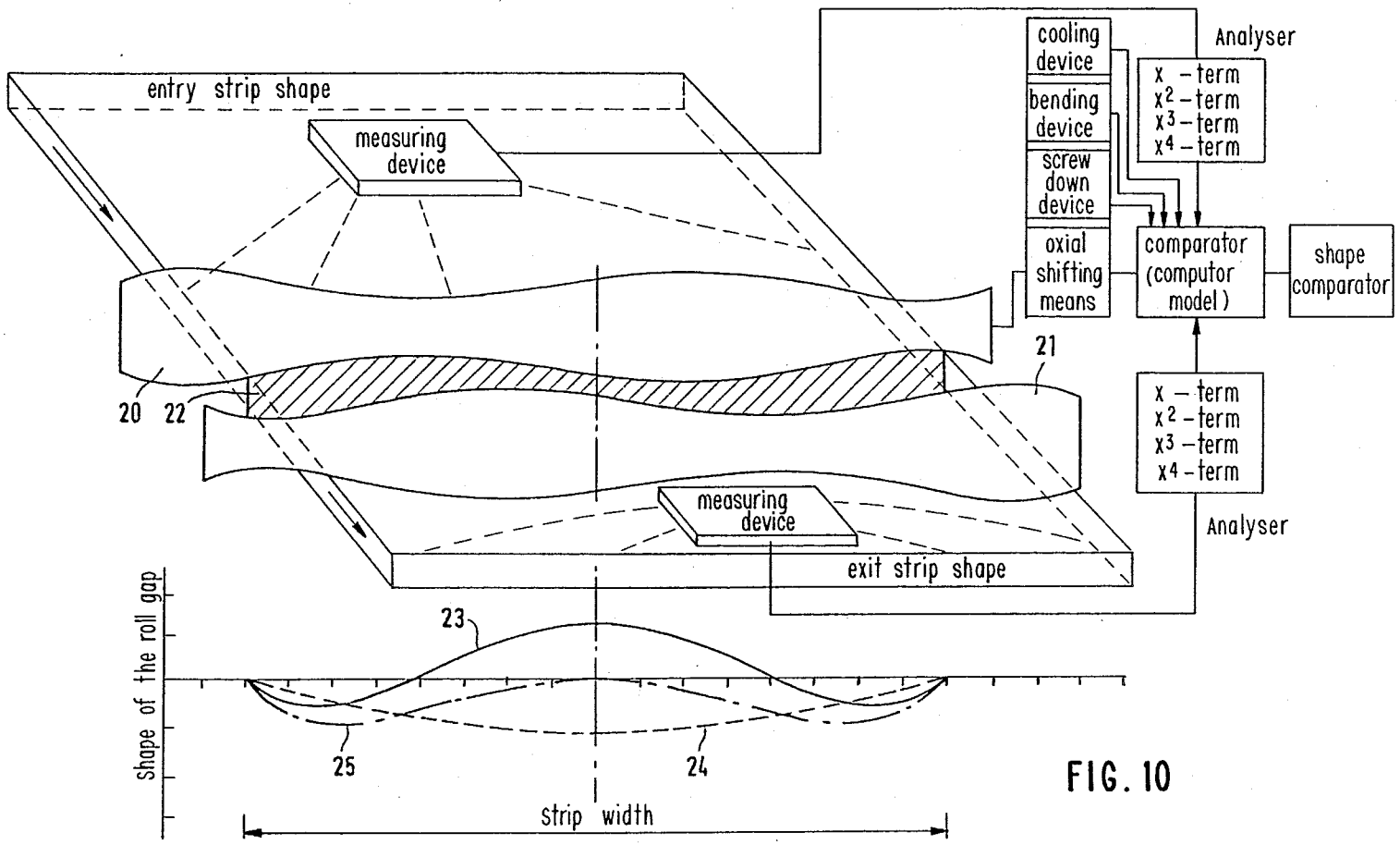
FIG. 10 is a perspective view showing a control system for the rolling mill stand according to the present invention.

Initially an analysis of the incoming strip contour is carried out. For this purpose, measurement points which reflect the contour are obtained by measurement systems provided at the input side or the contour is determined in prior operations and is then stored. This analysis determines the linear deviations, quadratic deviations and deviations of the fourth power of a strip entering a rolling mill train or a stand. The adjusting units are actuated on the basis of the determined values, in order to find the appropriate pivoting positions of adjustment, the distances by which the rolls are to be displaced and the bending forces. It is an advantage if not only the last stand or stands of the rolling mill train are adjusted in view of the pass schedule parameters, but all stands of the train, so that the roll gap contours occurring under load are adjusted to the strip contour. The regulating cycle is closed by a device shown in FIG. 10 for measuring the strip tension distribution within the mill train and/or following the last stand of the mill train, wherein the measured values are returned to the regulating device, and to close the regulating cycle, the adjustment units effect a further adjustment of the roll gap relative to the strip contour.

In each of these cases it is possible, particularly when supplemented by additional adjusting units, such as, bending devices, zone cooling or the like, to obtain correcting possibilities for the profile of a roll gap which are finely adjustable and essentially relatively uncomplicated and which, in addition, may be controllable, so that a strip can be rolled with minimum strip tension deviations and, thus, with optimum planeness.

While specific embodiments of the invention have been shown and described in detail to illustrate the application of the inventive principles, it will be understood that the invention may be embodied otherwise without departing from such principles.

We claim:

1. In a rolling mill stand with work rolls which are supported by back-up rolls or by intermediate and back-up rolls, wherein the work rolls, the intermediate rolls and the back-up rolls are axially slidable relative to each other into and out of a neutral position, the rolls having bodies with circumferential lines, the bodies being provided with alternatingly concavely and convexly shaped contours, such that the rolls supplement each other in at least one axial position of the rolls so that no gap exists between the rolls, wherein corrections of the roll gap between a pair of rolls are carried out by relative axial displacement of the rolls, the improvement comprising the contours of each of the rolls having in the neutral roll position thereof, in addition to a possible maximum in the middle, maximum inclinations of the circumferential lines on both sides of the middle of the circumferential surfaces of the rolls in longitudinal direction of the rolls in which roll gap profile changes are to be effected, wherein the contours of the rolls correspond in dependence upon the radius r from the respective axial position x to the equation $$r_{(x)}=a+bx+cx^2+dx^3+ex^4+fx^5$$

wherein the contours are determined by inserting given preferred fixed values into this equation.

2. The rolling mill stand according to claim 1, wherein the contour of a roll of a pair of rolls corresponds to the mirror image of the contour of the other roll of the pair.

3. The rolling mill stand according to claim 1, wherein more than one pair of rolls is provided, each pair of rolls having alternatingly concavely and convexly shaped contours, and wherein different pairs of rolls have different contours.

4. The rolling mill stand according to claim 1, wherein the contours of a pair of rolls represent the sum of at least two different functions.

5. The rolling mill stand according to claim 4, wherein the sum includes as its term at least two of the following functions:

(a) the function of a conventional roll body:

$$r_{(x)}=g+hx+ix^2;$$

(b) for adjusting a quadratic total effect, the function of conventional convexly or concavely or convexly-concavely shaped rolls:

$$r_{(x)}=j+kx+lx^2+mx^3;$$

and (c) for the compensation of edge or quarter area undulations of the $x^4$ order:

$$r_{(x)}=a+bx+cx^2+dx^3+ex^4+fx^5;$$

and wherein the respective factors are determined by given fixed values and by the position and magnitude of extreme values.

6. The rolling mill stand according to claim 1, wherein at least one of the pair of rolls is provided with bending devices.

7. The rolling mill stand according to claim 1, comprising a regulating unit, the regulating unit including means for analyzing a strip profile on the basis of a predetermined thickness value of the strip, on the basis of the thickness values determined through the strip width of the strip introduced into the rolling mill stand on the basis of the measurements of the distribution of strip tensions of the strip leaving the rolling mill stand, and means for determining on the basis of this analysis the optimum adjustment of the rolls, the optimum axial displacement of axially displaceable rollers and the bending forces to be applied for obtaining tension-free roll strip and any cooling values of a zone cooling, and means for effecting the optimum adjustment of the rolls, the optimum axial displacement and the bending forces and the cooling values.

* * * * *